US005744873A

United States Patent [19]

Hasegawa et al.

[11] Patent Number: 5,744,873

[45] Date of Patent: Apr. 28, 1998

[54] POWER SWITCH DEVICE FOR ELECTRIC VEHICLE INCLUDING URGING ELEMENT TO ROTATE AN ELECTRIC CONTACT INTO AN OPEN POSITION

[75] Inventors: Osamu Hasegawa; Satoshi Watanabe; Shigeru Suzuki; Katsuhiro Shinmen, all of Wako, Japan

[73] Assignee: Honda Giken Kogyo Kabushiki Kaisha, Tokyo, Japan

[21] Appl. No.: 622,413

[22] Filed: Mar. 27, 1996

[30] Foreign Application Priority Data

Apr. 5, 1995 [JP] Japan ..... 7-080508

[51] Int. Cl.[6] ..... H01H 9/00

[52] U.S. Cl. ..... 307/10.1; 200/4; 307/77; 307/119

[58] Field of Search ..... 307/9.1–10.7, 307/119, 49, 50, 77, 80, 85, 43; 200/4, 566, 16 R, 11 R; 429/150, 160

[56] References Cited

U.S. PATENT DOCUMENTS

| | | | |
|---|---|---|---|
| 2,451,224 | 10/1948 | Johnson | 200/4 |
| 4,716,263 | 12/1987 | Havel | 200/11 R |
| 5,169,735 | 12/1992 | Witehira | 429/160 |
| 5,256,502 | 10/1993 | Kump | 429/160 |
| 5,310,974 | 5/1994 | Churchill et al. | 200/566 |
| 5,552,642 | 9/1996 | Dougherty | 429/150 |

FOREIGN PATENT DOCUMENTS 6-6933 1/1994 Japan .

*Primary Examiner*—Richard T. Elms

*Attorney, Agent, or Firm*—Armstrong, Westerman, Hattori, McLeland

[57] ABSTRACT

A manual switch has an electric contact movable into and out of simultaneous contact with the first and second conductors, an angularly movable operating member, with the electric contact fixedly mounted thereon, angularly movable to bring the electric contact selectively into a closed or ON position in simultaneous contact with the first and second conductors and an open or OFF position out of simultaneous contact with the first and second conductors, and a torsion coil spring for forcibly angularly moving the operating member to move the electric contact into the open position to open the electric lines connected to the batteries when pressing forces are applied to the operating member with the electric contact in the closed position.

9 Claims, 5 Drawing Sheets

POWER SWITCH DEVICE FOR ELECTRIC VEHICLE INCLUDING URGING ELEMENT TO ROTATE AN ELECTRIC CONTACT INTO AN OPEN POSITION

BACKGROUND OF THE INVENTION

1. Field of the Invention

The present invention relates to a power switch device for use on an electric vehicle which can be propelled by an electric motor that is energizable by batteries connected to power supply lines.

2. Description of the Related Art

There are known electric vehicles, for example, electric automobiles, which has a power supply comprising a plurality of series-connected batteries and an electric motor connected to the power supply through power supply lines and energizable by electric energy supplied from the power supply for propelling the electric vehicle.

On such electric vehicles, the electric energy is supplied in most cases under a high voltage to the electric motor for better energy efficiency. Because of the high voltage used by the power supply system, it is desirable to open reliably the circuit of the power supply system when the power supply system is to be serviced for maintenance.

To meet such a demand, there has been proposed, as disclosed in Japanese laid-open patent publication 6-6933, a power supply breaker device having a power supply breaker means for disconnecting, upon a fault, common power supply lines which are connected to a plurality of block circuits through terminals that can be protected by protective covers. The power supply breaker device includes a switch means which can be turned on and off in ganged relation to the protective covers as they are attached and detached, and a breaker drive means for controlling the power supply breaker means to connect the power supply lines when the switch means is turned on and to disconnect the power supply lines when the switch means is turned off.

Since the switch means can be turned on and off in ganged relation to the protective covers as they are attached and detached, the breaker drive means actuates the power supply breaker means to disconnect the power supply lines unless at least one of the protective covers is attached. Therefore, the power supply lines can easily and safely be disconnected when the power supply system is to be serviced for maintenance.

According to the above disclosed power supply breaker device, the power supply lines are electrically disconnected when the breaker driver means (breaker drive circuit) actuates the power supply breaker means (breaker) based on a signal from the switch means (limit switch) that operated in ganged relation to the protective covers. Consequently, when the limit switch or the breaker drive circuit fails to operate properly, the power supply breaker device tends to operate in error or malfunction.

One solution is to design a fail-safe system for protection against a closed-circuit fault such as a fused contact condition of switches of the breaker. However, such a fail-safe system is highly complex in structure, and cannot easily be designed to incorporate a capability for confirming whether the power supply lines are disconnected when the power supply system suffers a fault.

SUMMARY OF THE INVENTION

It is a major object of the present invention to provide a power switch device for use on an electric vehicle, which allows power supply lines to be easily and reliably confirmed when they are opened or disconnected, can easily be operated, and is simple in structure.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
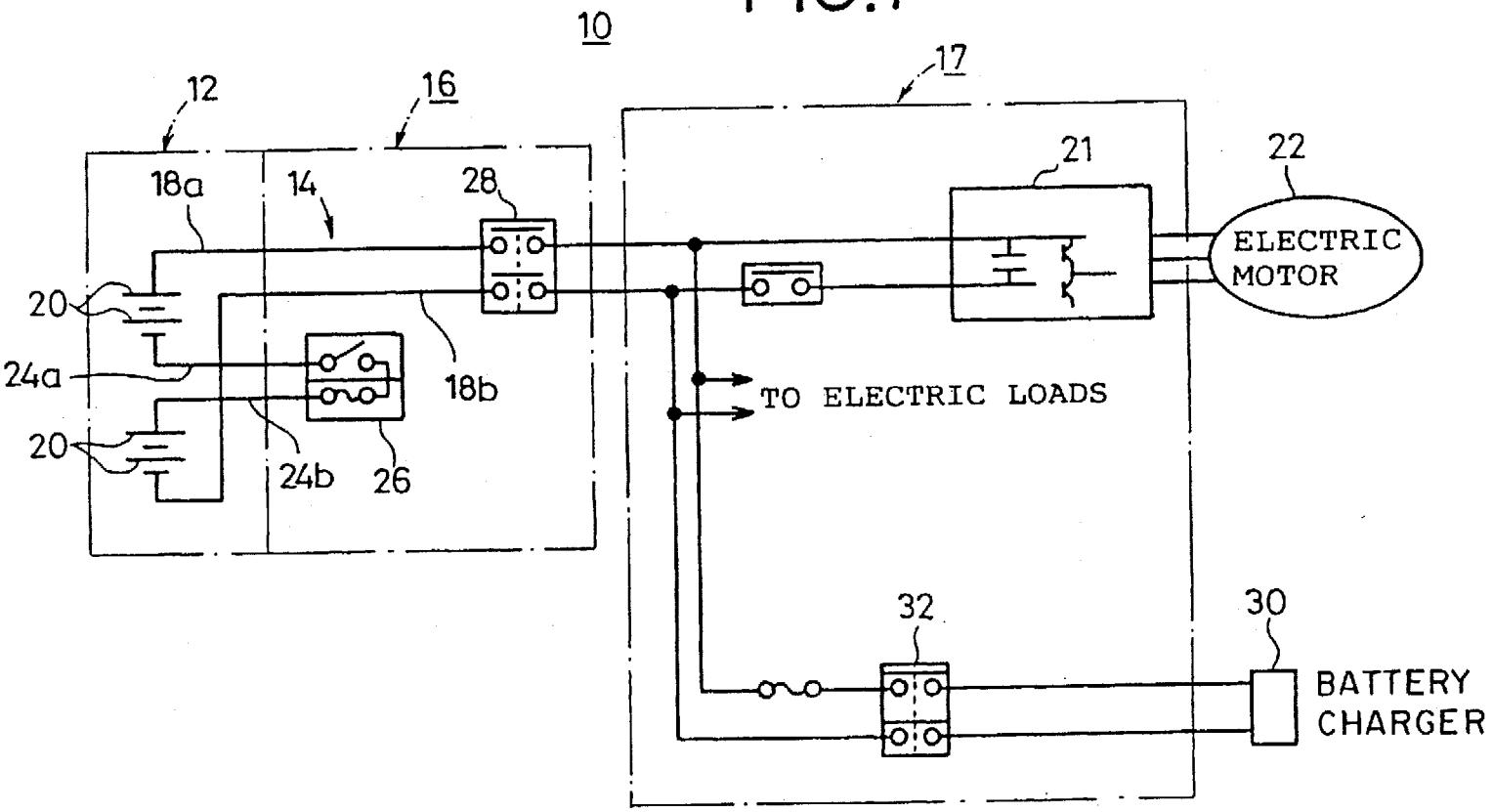
FIG. 1 is a circuit diagram of a power supply circuit which incorporates a power switch device for an electric vehicle according to the present invention.

FIG. 1 shows a power supply circuit 10 which incorporates a power switch device 14 for an electric vehicle (not shown) according to the present invention. As shown in FIG. 1, the power supply circuit 10 comprises a battery box 12, a main contactor box 16 which houses the power switch device 14 according to the present invention, and a precontactor unit 17. The battery box 12, the main contactor box 16, and the precontactor unit 17 are interconnected by power supply lines **18*a*, 18*b***.

The battery box 12 houses a plurality of series-connected batteries 20 which supply stored electric energy to an electric motor 22 through the power supply lines **18*a*, 18*b* and a driver 21**.

The main contactor box 16 is positioned over the battery box 12. The power switch device 14 comprises a manual switch 26 for selectively closing and opening, i.e., connecting and disconnecting, lines **24*a*, 24*b* that lead from a certain voltage-dividing point, e.g., an intermediate voltage-dividing point, in the batteries 20 and a main contactor 28 connected in series with the manual switch 26, for selectively closing and opening, i.e., connecting and disconnecting, the power supply lines 18*a*, 18*b*** in response to an operation of a key (key switch) of the electric vehicle.

The precontactor unit 17 has precontactor fuses (not shown) through which drive currents are supplied to the electric motor 22 and other various electric loads on the electric vehicle, and a contactor 32 whose contacts are connected when the batteries 20 are charged by an external battery charger 30.

Figure 2:
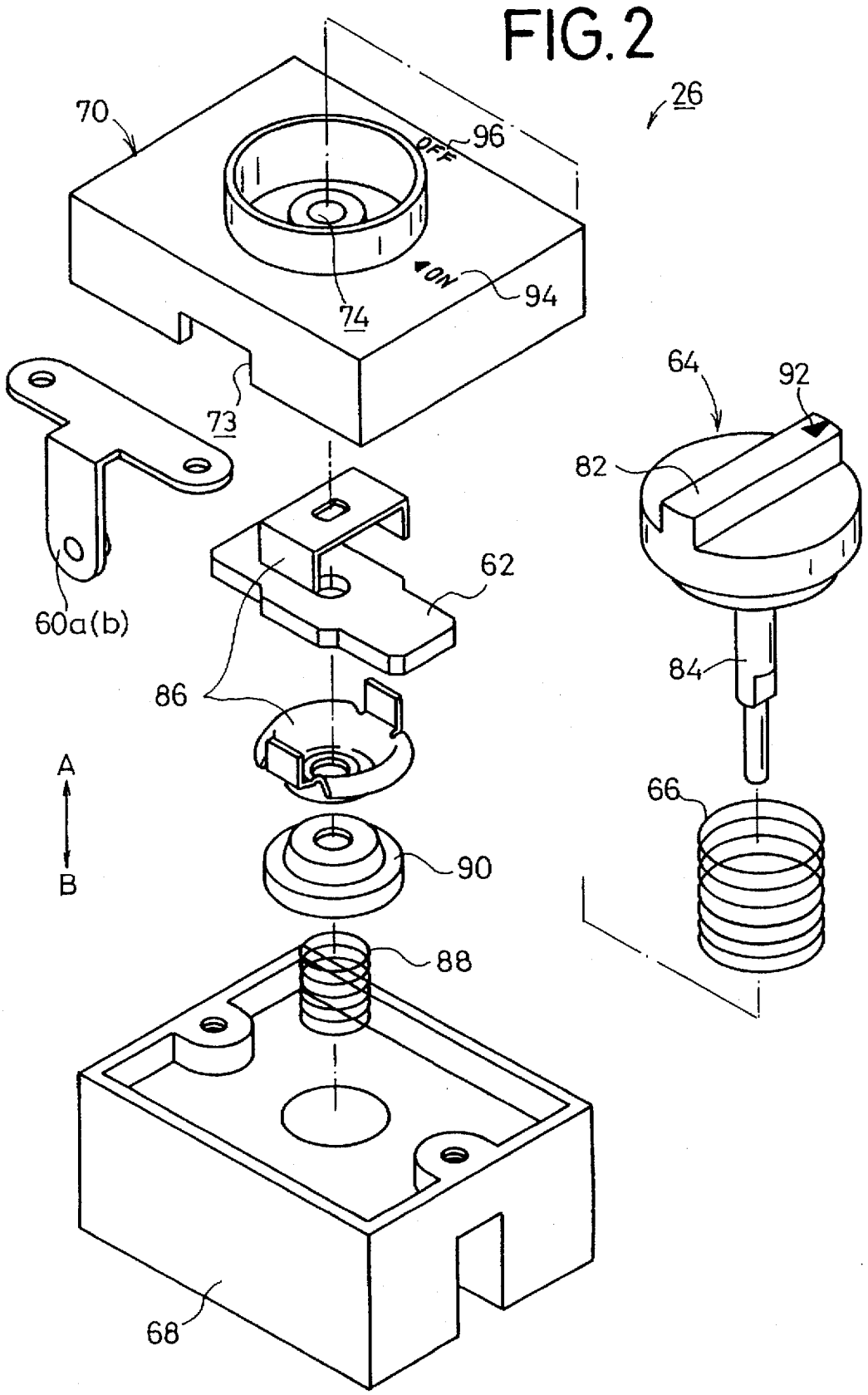
FIG. 2 is an exploded perspective view of a manual switch of the power switch device.
Figure 3:
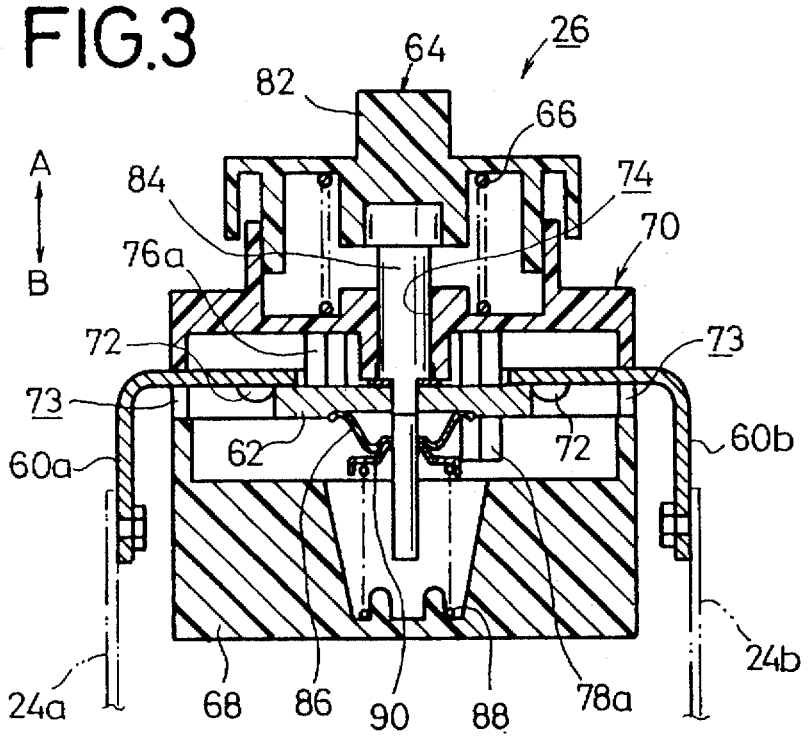
FIG. 3 is a vertical cross-sectional view of the manual switch.

As shown in FIGS. 2 and 3, the manual switch 26 comprises first and second conductors **60*a*, 60*b* connected to the lines 24*a*, 24*b*, respectively, an electric contact 62 that can be brought into and out of contact simultaneously with the first and second conductors 60***a*, 60*b*, an angularly movable operating member 64 for moving the electric contact 62 into an ON position (closed position) in which the electric contact 62 is held in contact with the first and second conductors 60*a*, 60*b* and an OFF position (open position) in which the electric contact 62 is held out of contact with the first and second conductors 60*a*, 60*b*, and a torsion coil spring 66 which operates as a urging means for forcibly turning the operating member 64 about 90° to move the electric contact 62 into the OFF position when depressing forces act on the operating member 64 with the electric contact 62 in the ON position.

The manual switch 26 has a lower case 68 and an upper case (case member) 70 which are joined to each other. The upper case 70, on which the operating member 64 is mounted, has an inner surface to which ends of the first and second conductors 60*a*, 60*b* are fastened by screws 72. The other ends of the first and second conductors 60*a*, 60*b* extend out of the upper case 70 through recesses 73 defined therein.

Figure 4:
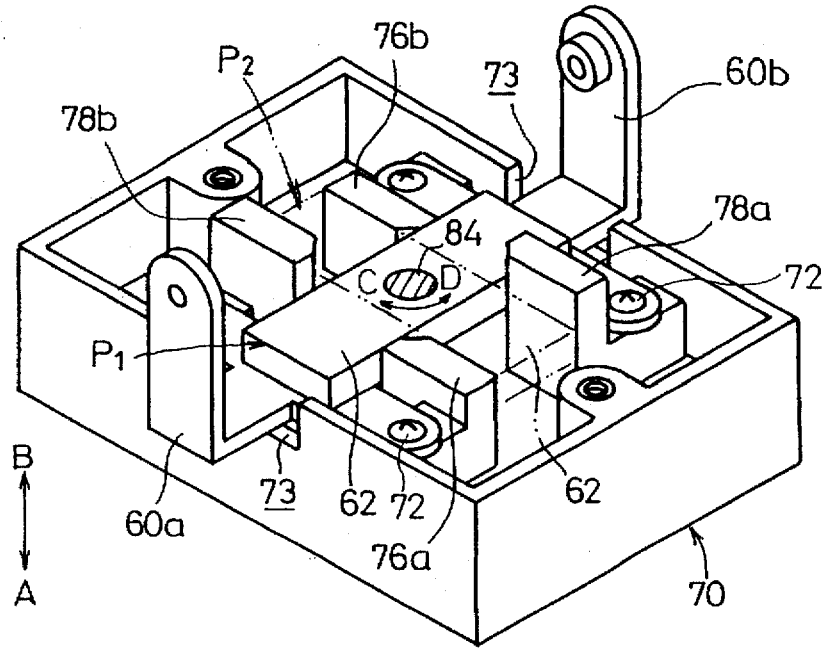
FIG. 4 is a perspective view, partly omitted from illustration, of the manual switch with an engaging member reversed.

As shown in FIGS. 2 through 4, the upper case 70 has central through hole 74 defined therein, and also has a pair of downwardly projecting shorter teeth 76*a*, 76*b* positioned diametrically across the central through hole 74 and a pair of downwardly projecting longer teeth 78*a*, 78*b* positioned diametrically across the central through hole 74.

The shorter teeth 76*a*, 76*b* and the longer teeth 78*a*, 78*b* function as engaging means for allowing the electric contact 62 to be angularly moved only when it is subject to pressing forces in the direction indicated by the arrow B at the time the electric contact 62 is in the ON or OFF position. The longer teeth 78*a*, 78*b* have a stopper capability for stopping the electric contact 62 against angular movement in the direction indicated by the arrow C (FIG. 4) beyond a position $P_1$ (ON position) and also against angular movement in the direction indicated by the arrow D (FIG. 4) beyond a position $P_2$ (OFF position).

The operating member 64 has a grip 82 on its upper surface and an angularly movable shaft 84 extending downwardly away from the grip 82 from a central portion of the operating member 64. The shaft 84 is fitted in the central through hole 74 in the upper case 70 and extends downwardly into the lower case 68. The electric contact 62 is fixed to the shaft 84 at its intermediate portion by a fixing member 86. A spring 88 is disposed in the lower case 68 for applying resilient forces to the electric contact 62 through a spring seat 90 for normally urging the operating member 64 to move in the direction indicated by the arrow A.

To give a visual aid to assist the operator in smoothly and reliably operating the manual switch 26, the grip 82 has an indicator mark 92 (see FIG. 2) on its upper surface, and the upper case 70 has an ON mark 94 and an OFF mark 96 at 90°-spaced positions on its upper surface which indicate the positions $P_1$, $P_2$, respectively. As described later on, when the electric contact 62 is in the position $P_1$, the indicator mark 92 points to the ON mark 94, and when the electric contact 62 is in the position $P_2$, the indicator mark 92 points to the OFF mark 96.

The torsion coil spring 66 is disposed between a lower surface of the operating member 64 and an upper surface of the upper case 70. The torsion coil spring 66 normally biases the operating member 64 to turn from the ON position to the OFF position.

Operation of the power switch device 14 will be described below.

In FIG. 4, when the electric vehicle is to run normally, the manual switch 26 is closed or turned on, and the main contactor 28 is actuated by the key of the electric vehicle which is operated. The battery box 12 supplies electric energy through the power supply lines 18*a*, 18 to the electric motor 22 for thereby propelling the electric vehicle.

When the power supply circuit 10 is to be serviced for maintenance, the operator operates the key of the electric vehicle to cause the main contactor 28 to disconnect the power supply lines 18*a*, 18*b*.

Figure 5:
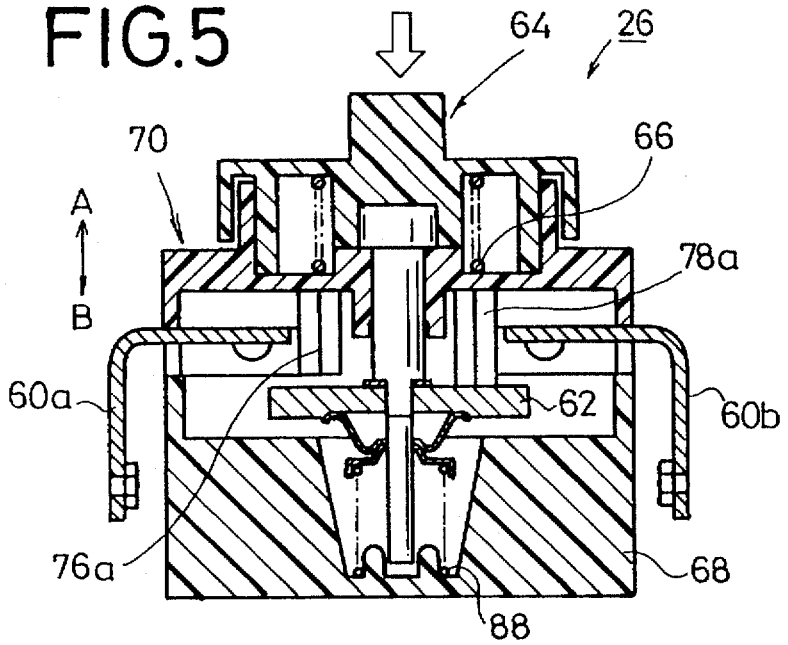
FIG. 5 is a vertical cross-sectional view of the manual switch with an operating member pressed.

Then, the operator depresses the operating member 64 of the manual switch 64 in the direction indicated by the arrow B in FIG. 5. The operating member 64 is now displaced in the direction indicated by the arrow B against the bias of the spring 88, moving the electric contact 62 fixedly mounted on the shaft 84 out of contact with the shorter teeth 76*a*, 76*b*.

Figure 6:
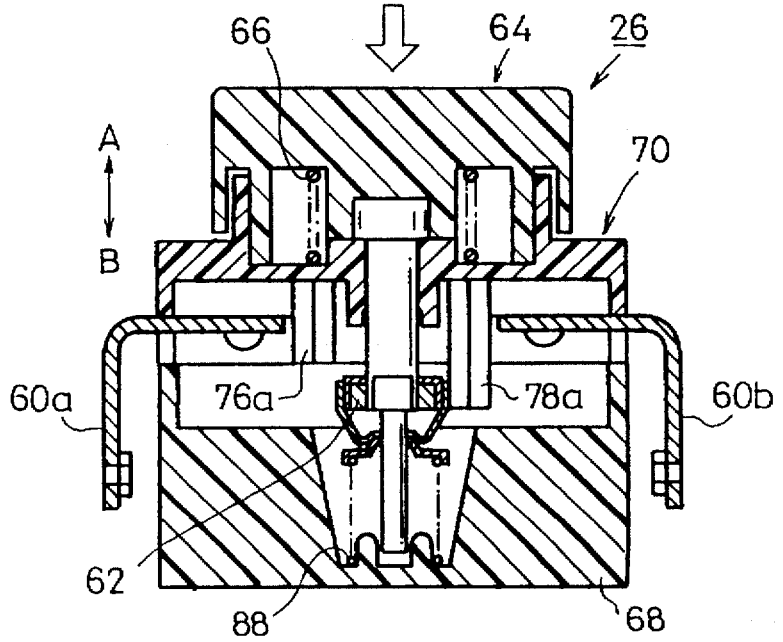
FIG. 6 is a vertical cross-sectional view of the manual switch with the operating member angularly moved from an ON position to an OFF position.
Figure 7:
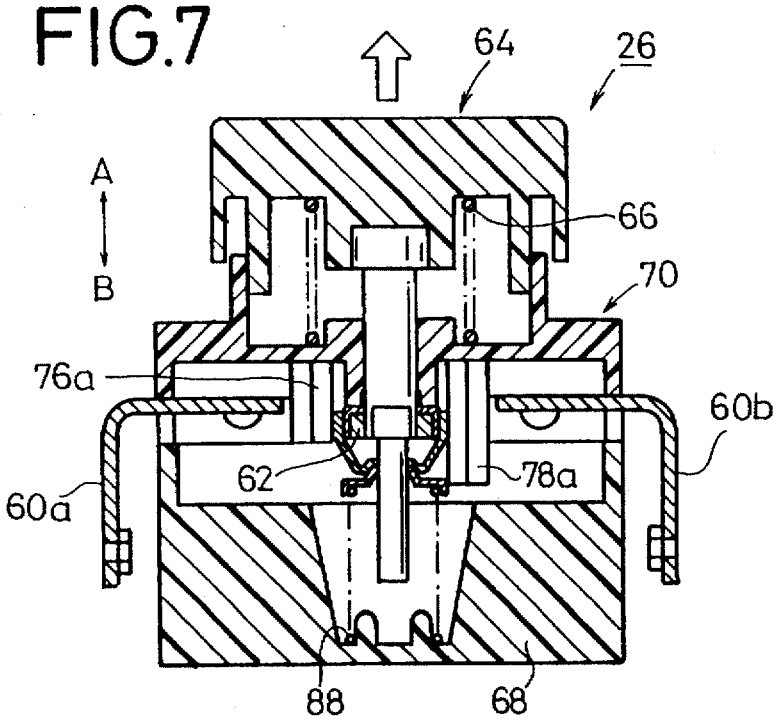
FIG. 7 is a vertical cross-sectional view of the manual switch with the operating member released from pressing forces in the OFF position.

Since the operating member 64 is normally biased to turn from the ON position to the OFF position by the torsion coil spring 66, when the electric contact 62 moves out of contact with the shorter teeth 76*a*, 76*b*, the operating member 64 is forcibly angularly moved in the direction indicated by the arrow D from the ON position (position $P_1$, see FIG. 4) to the OFF position (position $P_2$, see FIG. 4) until the electric contact 62 abuts against the longer teeth 78*a*, 78*b* as shown in FIG. 6. When the operating member 64 is released of the depressing forces as shown in FIG. 7, the operating member 64 moves together with the electric contact 62 in the direction indicated by the arrow A. The electric contact 62 is now held in the OFF position, electrically disconnecting the first conductor 60*a* and the second conductor 60*b* from each other. At this time, the indicator mark 92 on the grip 82 points to the OFF mark 96 on the upper case 70.

Because the manual switch 26 is now turned off, the circuit is broken at the intermediate voltage-dividing point in the batteries 20. The power supply circuit 10 is therefore reliably broken or turned off even if the main contactor 28 is not turned off. Consequently, the power supply circuit 10 can smoothly be serviced for maintenance.

The power switch device 14 according to this embodiment includes the manual switch 26 which has the indicator mark 92 on the operating member 64 and the ON mark 94 and the OFF mark 96 on the upper case 70. These visual marks permit the operator to easily and reliably recognize visually whether the power supply lines 18*a*, 18*b* are opened or not based on the positional relationship between the visual marks.

The power supply lines 18*a*, 18*b* can selectively be closed and opened by a simple mechanical arrangement which brings the electric contact 62 selectively into and out of simultaneous contact with the first and second conductors 60*a*, 60*b* connected to the batteries 20. Such a simple mechanical arrangement is subject to less malfunctioning than the conventional arrangement which would electrically control the opening of the power supply lines 18*a*, 18*b*. Consequently, the power supply lines 18*a*, 18*b* can reliably be opened by the arrangement according to the present invention.

The manual switch 26 causes the operating member 64 to be forcibly angularly moved from the ON position to the OFF position under the bias of the torsion coil spring 66 when the operator simply presses the operating member 64 in the direction indicated by the arrow B. Therefore, the manual switch 26 can be operated with ease.

For returning the operating member 64 from the OFF position to the ON position, the operator angularly moves the operating member 64 about 90° toward the ON position while pressing the operating member 64 in the direction indicated by the arrow B. The electric contact 62 is now held against the longer teeth 78*a*, 78*b*. When the operator then releases the operating member 64, the operating member 64 is forcibly displaced in the direction indicated by the arrow A under the resiliency of the spring 88 until the electric contact 62 contacts the first and second conductors 60*a*, 60*b*. At this time, the indicator mark 92 on the grip 82 points to the ON mark 94 on the upper case 70.

The power switch device 14 according to the present invention offers the following advantages:

When the operator presses the operating member, the operating member is forcibly turned by the urging means, bringing the electric contact from the closed position (ON position) to the open position (OFF position) for thereby reliably opening the power supply lines. The operator can easily and reliably recognize visually whether the power supply lines are opened or not, and can smoothly service the power supply circuit for maintenance. The electric contact of the manual switch can be brought into and out of contact simultaneously with the first and second conductors that are connected to the batteries. The manual switch has a simple arrangement which allows the operator to know reliably whether the power supply lines are opened or not.

Although a certain preferred embodiment of the present invention has been shown and described in detail, it should be understood that various changes and modifications may be made therein without departing scope of scope of the appended claims.

What is claimed is:

1. A power switch on an electric vehicle which can be propelled by an electric motor energizable by a plurality of batteries connected to power supply lines, comprising:

a manual switch associated with a battery box which houses the batteries;

said manual switch comprising:

a housing including a case member;

first and second conductors, at least one of the first and second conductors being electrically connected to the batteries;

an electric contact disposed for movement inside said housing into and out of simultaneous contact with the first and second conductors;

an angularly movable operating member rotatably mounted on said case member, said electric contact being fixedly mounted on said angularly movable operating member, said angularly movable operating member being angularly movable to bring said electric contact selectively into a closed position in simultaneous contact with the first and second conductors;

a plurality of stationary teeth disposed in said case member for engagement with said electric contact; and torsional urging means disposed in said housing for applying a torque to said operating member to rotate said electric contact into an open position to open the power supply lines connected to the batteries when a pressing force is applied to said operating member with said electric contact in said closed position.

2. A power switch device according to claim 1, wherein said urging means comprises a torsion coil spring for normally urging said operating member from said closed position to said open position.

3. A power switch device according to claim 1, wherein said plurality of teeth allow said operating member to be rotated only when said operating member is pressed with said electric contact in said closed position or said open position.

4. A power switch device according to claim 3, wherein said manual switch further comprises a spring for normally urging said operating member in a direction to keep said electric contact in engagement with said engaging means.

5. A power switch device according to claim 1, wherein said teeth include:

a pair of shorter teeth engageable by and disengageable from said electric contact when said operating member is pressed; and a pair of longer teeth for engaging said electric contact for limiting angular movement thereof when said electric contact disengage from said shorter teeth.

6. A power switch device according to claim 1, wherein said case member has an ON mark indicative of said closed position and an OFF mark indicative of said open position, said operating member having an indicator mark for selectively pointing to said ON mark and said OFF mark when the operating member is rotated to bring said electric contact into said closed position and said open position, respectively.

7. A power switch device according to claim 1, wherein said batteries are connected in series with each other, and said first and second conductors are connected to a predetermined voltage dividing point in said batteries.

8. A power switch device according to claim 1, further comprising a main contactor connected in series with said manual switch, for supplying electric energy from said batteries to said electric motor.

9. A power switch according to claim 1, further comprising second urging means disposed in said housing for applying a force in a direction opposite to said pressing force for normally urging said operating member outwardly from said housing.

* * * * *